US009040875B2

(12) United States Patent
Naidu et al.

(10) Patent No.: US 9,040,875 B2
(45) Date of Patent: May 26, 2015

(54) THERMAL PIXEL ARRAY DEVICE

(76) Inventors: Prakash C R J Naidu, Ottawa (CA); Milos R Popovic, Mississauga (CA); Kshirsagar C J Naidu, Ottawa (CA)

( * ) Notice: Subject to any disclaimer, the term of this patent is extended or adjusted under 35 U.S.C. 154(b) by 636 days.

(21) Appl. No.: 12/763,744

(22) Filed: Apr. 20, 2010

(65) Prior Publication Data

US 2011/0168685 A1 Jul. 14, 2011

(30) Foreign Application Priority Data

Oct. 20, 2009 (CA) ..... 2682973

(51) Int. Cl.
*H05B 3/00* (2006.01)
*H05B 3/10* (2006.01)

(52) U.S. Cl.
CPC ..... *H05B 3/10* (2013.01)

(58) Field of Classification Search
USPC ..... 219/201
See application file for complete search history.

(56) References Cited

U.S. PATENT DOCUMENTS 4,741,338 A * 5/1988 Miyamae ..... 607/112
2009/0258120 A1* 10/2009 Zeitler et al. ..... 426/232

* cited by examiner

*Primary Examiner* — Dale E Page

(57) ABSTRACT

A thermal pixel array stimulating device is disclosed providing flexibility between the different pixels of the array to enable wrapping of the device over a curved surface of the human body by connecting the pixel substrates by flexible material or linkages. The distance between the pixels may further optionally be adjustable. A controller may control the temperature pattern generated by the array. The controller may be programmable to provide a temperature pattern. Individual pixels may be provided with sensors to measure stimulus, with the outputs from such sensors being directed to data recordal and display devices. Stimulation modes provided may include at least one of vibratory stimulation, actuation stimulation, thermal stimulation or a combination of two or more of them.

18 Claims, 11 Drawing Sheets

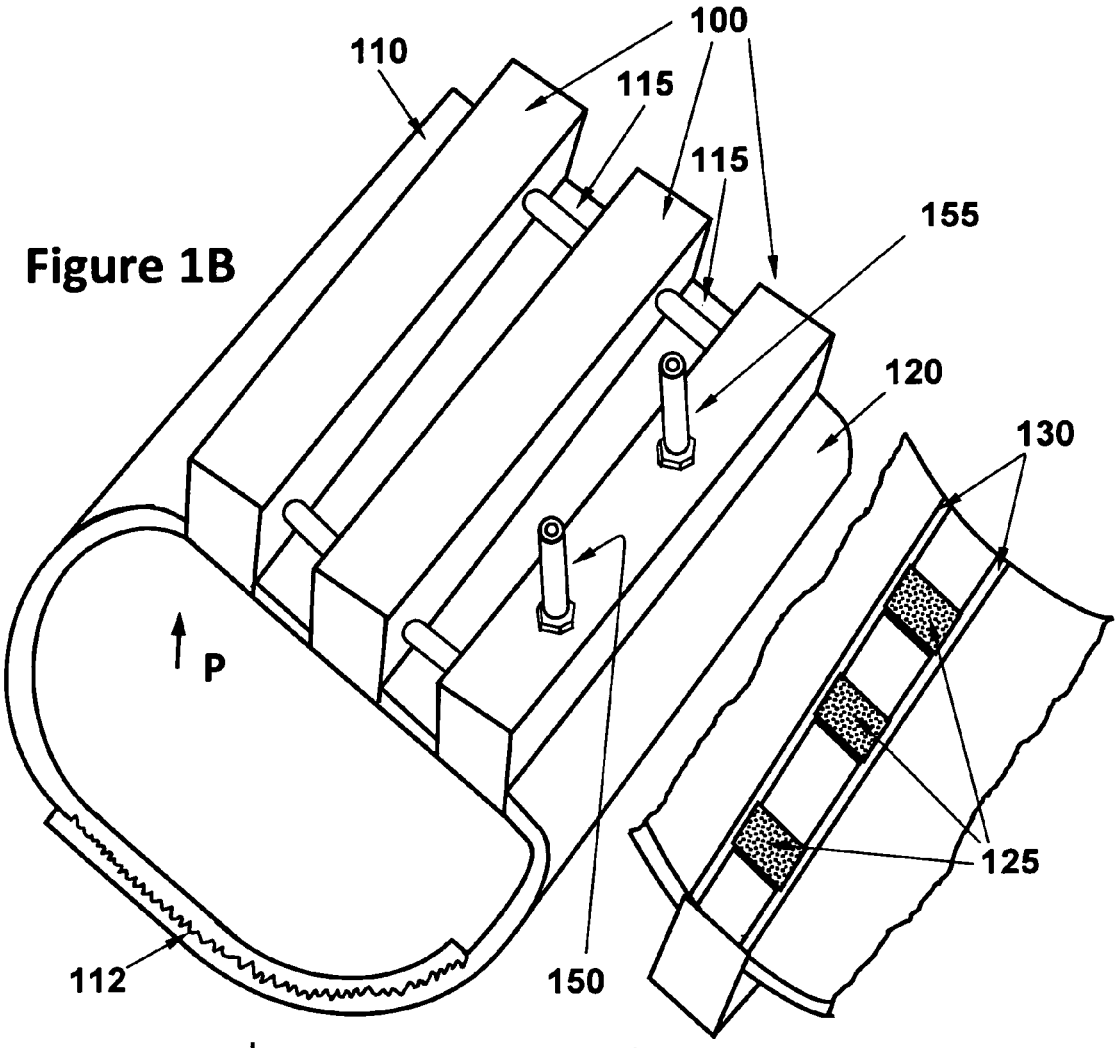
Figure 1B
Figure 1C
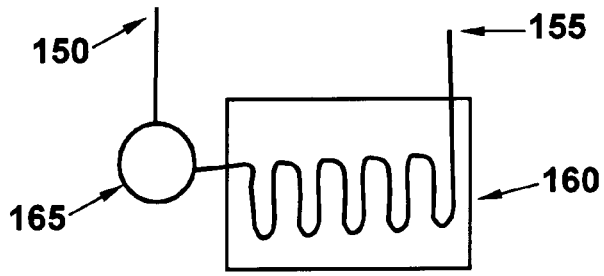
Figure 1D (enlarged Section A-A)

Section B

Section C

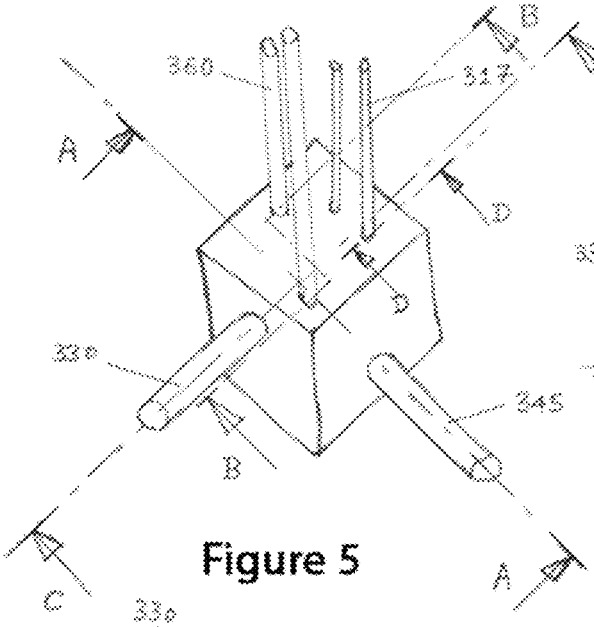
Figure 5
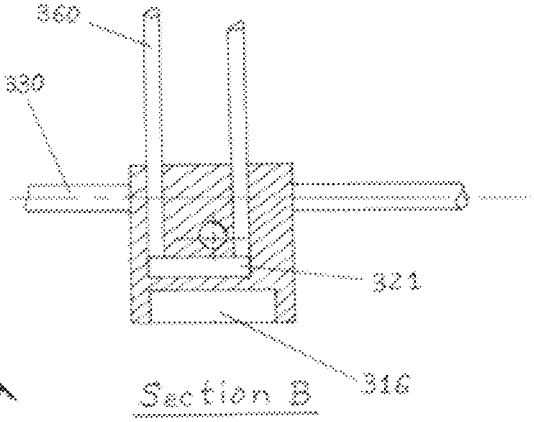
Figure 5B
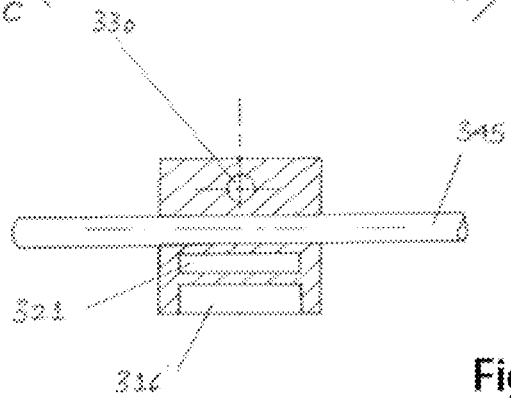
Section A
Figure 5A
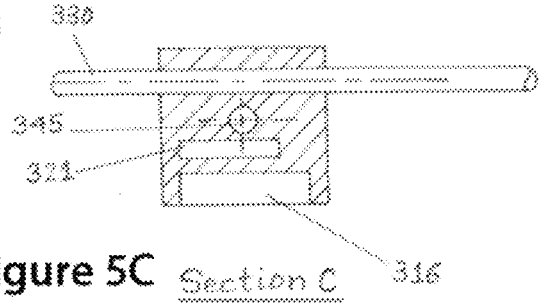
Figure 5C
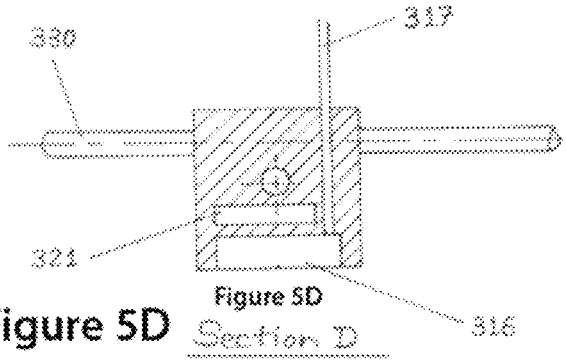
Figure 5D
Figure 5D

THERMAL PIXEL ARRAY DEVICE

RELATED CANADIAN PATENT APPLICATION

This application claims the benefit of Canadian Patent Application No. 2,682,973, filed Oct. 20, 2009, including all the written description of the inventions described therein and making claim to the inventions disclosed therein.

BACKGROUND OF THE INVENTION

This invention relates to modes of stimulation including vibration, actuation and thermal stimulation in human-machine interfaces such as biomechanical communication and computer based gaming experience. Some aspects of the invention are applicable to medical and biomedical equipment for treatment, testing, or experimentation on sensory pain due to thermal stimulation. Other modes of stimulation including actuation and vibration for therapeutic and rehabilitation purposes are also applicable.

Vibratory and actuation stimulation for use in biomechanical communication such as vibration based message transmission, and human-machine interfaces such as enhanced experience during computer based gaming is a recognized need. Multi-point programmable stimulation on human body can be a very useful means for communication not only for persons challenged in receiving information through conventional visual or auditory means but also for general purpose applications. For example, there is emergence of vibratory tones in mobile phones to distinguish between the different callers so that the receiver of the call may identify the caller covertly without looking at the display of the mobile phone or listening to an auditory ring tone that disturbs others. In the gaming systems, there is growing need for increased sensory stimulation of different body parts of the gamers for multi-modal immersive feeling although currently the stimulation is mainly limited to joystick interfaces. Examples of these applications include vibration by means of eccentric motor actuators (Yoshida et al, U.S. Pat. No. 7,157,822; Tremblay et al, U.S. Pat. No. 6,275,213), piezoelectric actuators (Gouzman et al, U.S. Pat. No. 5,912,660; Kyung et al, U.S. Pat. No. 7,339,574), and pressurized fluid actuators (Roberts et al, U.S. Pat. No. 7,352,356). The motor based and piezoelectric actuators based array systems suffer from constraints in miniaturization due to minimum size of actuator elements that makes it difficult to embed them on a wearable substrate with the desirable flexibility and space resolution. The entire body of a motor vibrates instead of a desired specific area coming in contact with a human body. Piezoelectric elements that create enough perturbation are long strips required to be deposed in cantilever configuration for desired vibration near the tip. The pressurized fluid actuators based system requires a complex grid of valves for control of actuation, again imposing difficulty in miniaturization, embedding, and achievement of close spacing.

In the medical and biomedical field, application of a range of temperatures from cold to hot by contact of an embodiment on a human body part in order to find the sensory stimulus, and to measure the threshold of the thermal stimulus causing pain is a known requirement. U.S. Pat. No. 5,191,896 (Gafni et. al.) and the references listed therein, the contents of which are adopted herein in total by reference, describe in detail this requirement. U.S. Pat. No. 5,634,472 (Raghuprasad) claims a method of determining the severity of pain at a selected area of a person's body according to a series of steps. U.S. Pat. Nos. 6,113,552 and 7,399,281 (Shimazu et. al.) claim pain measurement systems that focus on electrical stimulus, not on thermal stimulus. The apparatus disclosed in the relevant prior patent (U.S. Pat. No. 5,191,896) applies the thermal stimulation by a single stimulator comprising one or more Peltier elements inside the stimulator. The apparatus has several limitations. The stimulator provides only a single embodiment in contact with the human body whereas recent research and efforts towards development of test-in-principle experimental set ups (e.g., Hunter et. al., Defrin et. al., Cohen et. al., Monbureau, Bouhassira et al, Craig et. al.) have shown a need for experimentation that has an array of several pixels in contact with the human body with a provision to vary temperatures of the pixels independently to form a pattern of different hot and cold temperatures concurrently. Yet another limitation is that the embodiment comprises heating elements arrangement that has constraints including lack of flexibility, and limitation in miniaturization. Further, the embodiment coming in contact with the human body is flat and rigid and thus can not be flexibly brought in contact with a curved surface of the body for assessing the effects of thermal stimulation on different locations of such curved surface simultaneously. Still another limitation of the prior art is that the distance between different points of hot and cold stimulus on human body can not be varied as the device has the stimulator with only a fixed single surface available for contact with the human body. In addition to the thermal stimulation for research in pain sensation, there is emerging potential for vibration stimulation for therapeutic and rehabilitation applications. Example of such application is Vibration Stimulation Therapy Apparatus, Its Use, Method, and Computer Program disclosed by Kawahira et al (PCT Pub. No. WO/2006/134999). However, the disclosure does not provide independently controllable multi-pixel stimulation compliant to curved surface using thermal means. Also, possibility to combine thermal and vibratory stimulation is not reported.

Aspects of the present invention overcome some of the difficulties in prior art either individually or in combination with each other. The advantages of the present invention will become apparent from the description and accompanying drawings.

BRIEF SUMMARY OF THE INVENTION

A thermal pixel array device is disclosed wherein one or more heating-cooling pixels are held such that at least one of a vibratory, an actuation, and a thermal stimulation element can substantially contact a curved surface providing with the ability to comply with a curved human body part, and parameters of stimulation of individual elements in the array may be controlled in a programmable manner. According to an aspect of the invention, actuation and vibratory stimulation can be achieved by using the thermal energy of the pixels for actuation and/or vibratory motion. The programmable controller employed in order to program the pattern of temperatures of the pixels can be advantageously used for generating different amplitudes and frequencies of vibration.

Aspects of present invention provide flexibility between the different pixels of the array to enable wrapping of the thermal pixel array device over a curved surface of the human body by connecting the pixel substrates by flexible material or linkages. In one embodiment of this aspect, the pixel housing heat sinks are connected by means of a flexible material such as rubber, or fabric material, and coolant is transmitted between heat sinks through flexible pipes. In another embodiment of this aspect the pixel housing heat sinks are mounted on a hollow rubber bag that facilitates circulation of cooling medium and at the same time provides flexibility of connection between the pixels. Further, preferably but optionally, the heat sinks may be eliminated by ensuring direct contact between heaters and cooling medium. In addition, preferably but optionally, the heaters may be flexible in the form of flexible heaters such as Kapton™ heaters or rubber heaters without necessarily the use of rigid heating-cooling elements such as Peltier or Ceramic elements.

Further, preferably but again optionally, and in addition the distance between the pixels can be changed either by sliding the pixels over guiding elements or by expansion of the connections between the pixels. According to one embodiment of the present invention, means to vary the distance between pixels by sliding and clamping the heaters at desired distance between them in one direction is provided. The distance between the pixels in other direction perpendicular to the aforementioned direction can be changed by stretching the connecting material between pixel housing heat sinks that is stretchable in addition to being flexible in an embodiment where this aspect of distance variability in both directions is desired. In yet another embodiment of the invention, the pixel housing heat sinks can be slided over guiding cables in two directions perpendicular to each other and the blocks holding the two ends of the cables can be clamped after the distance between the pixels is set as desired.

Courting to a further feature of the invention, the device can be portable and wearable like a cuff on a human body part.

Further, the device is provided with temperature sensors associated with each of the pixels, such sensors being preferably connectable to a programmable controller consisting one or more data acquisition units. The programmable controller can be programmed to provide a thermal pixel array device that can present to the human body part a pattern of pixels of different amplitude or different frequencies or both different amplitudes and frequencies of vibrations or different amplitudes of actuation or different temperatures simultaneously. Such pattern may be static or dynamic, i.e. varying with time. The controller may record and display the vibration, actuation, or temperature stimulus either individually or a combination of more than one type of stimulus; and human response information on a display screen.

BRIEF DESCRIPTION OF THE SEVERAL VIEWS OF THE DRAWING

FIG. 1B shows one embodiment of the underlay of the invention having elongated heat sink strips connected with each other by flexible and stretchable material and heater pixel modules mounted on the strips such that they can be slided and clamped. FIG. 1C is a view as seen from the front of the heater pixels. FIG. 1D shows a pump and coolant unit schematic.

FIG. 5 illustrates one configuration of the detailed structure of a pixel module of FIG. 4. The cross sectional views of FIG. 5 are FIGS. 5A, 5B, 5C, and 5D.

DETAILED DESCRIPTION OF THE INVENTION

Figure 1:
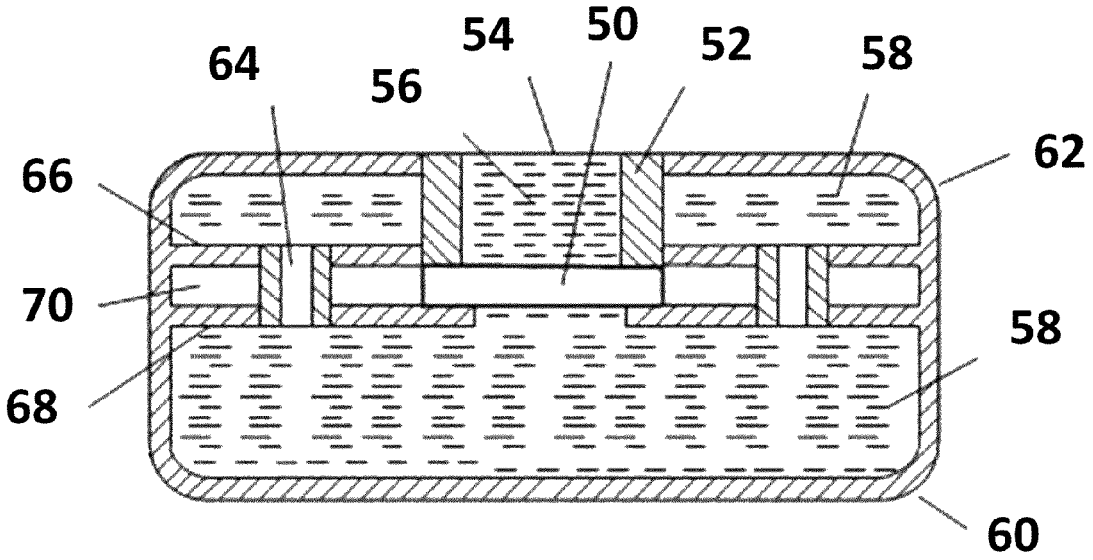
FIG. 1 shows cross sectional view of an embodiment of the invention wherein a heater pixel module has an overlay for providing actuation and/or vibration stimulation.
Figure 1A:
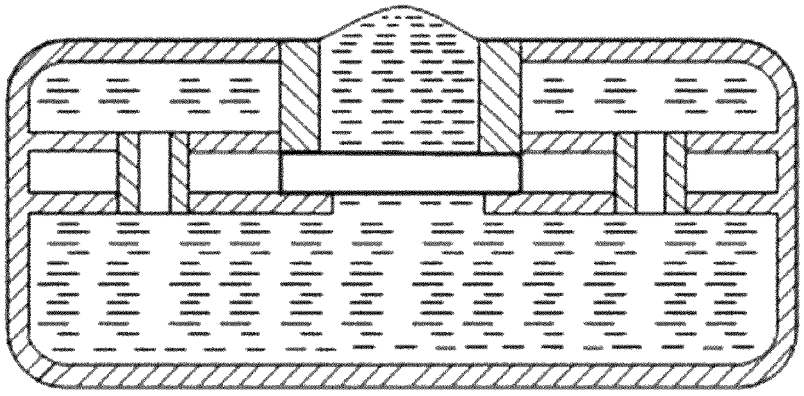
FIG. 1A shows a displaced state of flexible film in the overlay that provides actuation and/or vibration stimulation.

An embodiment of the invention is illustrated in FIG. 1 wherein a heater element 50 has an overlay of a fluid chamber enclosed by wall 52 on the sides and a flexible film cover 54 of the chamber that displaces with change in temperature of the fluid 56 resulting in actuation and/or vibration stimulation to a body part in contact with the film. FIG. 1A shows a displaced state of flexible film that provides actuation and/or vibration stimulation. These stimulations can be in addition to thermal stimulation as the flexible film is found to get heated and cooled along with the actuation cycle. A combination of two or more stimulations is also possible. Different amplitudes and frequencies of vibration may be generated by advantageously using the programmable controller employed in order to program the pattern of temperatures of the pixels. It is found that voltage higher than that used for thermal stimulation may be employed for generating actuation and vibration, for example 2-5V is generally adequate for thermal stimulation, where as 2V-12V is generally suitable for perceptible vibration stimulation depending on the size of heater and amplitude of vibration desired. Several versions of this embodiment are feasible. For example, an additional but optional overlay (not shown in figure) may house a pin (not shown in figure) that may provide guidance around the cylindrical surface of the pin allowing it to move in actuation mode or vibration mode in a direction substantially perpendicular to the flexible film 54. The pin may receive the required movement in a direction along its axis through the movement of the film 54. In another version, the pin may directly engage with the inner walls 52 of the fluid chamber in a slidable manner with close fit like a piston and move in actuation mode or vibration mode in a direction perpendicular to the heater element 50. The heater pixel module may be a Peltier heater that can be also used as a cooler by reversing the direction of flow of current through the device. This heating and cooling is found to be adequate for cyclic functioning of the device with frequency of 1 to 20 Hz with up to 50% duty cycle that fulfills the need of many stimulation applications. For higher frequencies and/or higher duty cycles and/or for another version having heater pixel module as conventional ceramic, Polyimide, Kapton™ or rubber heater; additional cooling around the enclosure wall may be desirable. This is achieved by allowing the cooling medium fluid 58 used for cooling the heater pixel module to be circulated around the enclosure wall 52. In one configuration of the version of this embodiment, the bag structure 60 holding the heater and facilitating circulation of cooling medium fluid 58 has extended part 62 to enclose the wall 52 of fluid chamber and a passage 64 is provided for the cooling medium to circulate around the wall. Although in the FIG. the wall appears to be cylindrical, it may be of many other shapes such as cubical, prismatic, or conical wherever possible. For example, the wall may be preferably cylindrical if a pin piston has to slide inside the wall, but maybe of any other shape for actuation of film without a part of pin sliding inside the chamber enclosed by the wall. It is found that narrowing of the cross section of the fluid chamber for closer center to center spacing of the pixels reduces the heating capacity generated by the heater pixel module alone and hence optionally, alternatively, or additionally heating coil may be embedded in the wall 52. For example, the wall may be multiple layers of Kapton™ (DuPont®, Wilmington, Del., USA) film with heater coil (for example, Ni-Cr60 resistor, Goodfellow Cambridge Ltd, England, U.K.) embedded between the layers providing a laminated heater wall. Alternately, an off-the-shelf flexible Polyimide heater (for example, Minco Model No. 5565, Minco, Minneapolis, Minn., USA) can be customized or configured in a cylindrical, cubical, or other suitable shape and the joint sealed to form the wall 52. It is found that Kapton™ is particularly well suited for this application due to its endurance to cyclic heating and cooling, and relatively superior thermal conductivity amongst flexible materials. It is found that this can be further improved by using special versions of Kapton™ (for example, Corona Resistance Kapton® CR has thermal conductivity about twice that of standard Kapton™ and life endurance about 500 times that of standard Kapton™). Other variants of Kapton™, for example, thermally conductive adhesive and thermally conductive Silicone rubber coated Kapton™ such as K271 tape (Saint-Gobain, Valley Forge, Pa., USA) may be used to further improve the thermal conductivity. The thermal conductivity is found to be important for this application as the thermal energy generated by the coils needs to reach the fluid 56 as fast as possible for short response time for actuation. Good thermal conduction is also advantageous for the heat to be taken out from the fluid chamber during cooling so that residual heat is minimized as it causes hysteresis effect in actuation. Hysteresis is offset in actuation which is the amount of distance that remains a displacement after the transition from ON to OFF state of the pixel heater 50. If the cooling is not fast enough to eliminate residual heat, the offset accumulates over a period of time and the device no longer is able to provide the desired cyclic stimulation.

The configuration shown in FIG. 1 represents only one of the different embodiments that can be conceived within the scope and spirit of the invention in which thermal energy is used for stimulation of a human body part, and all such inventions are covered by this disclosure. Those skilled in the art can appreciate that the overlay and any variant configurations are applicable for the underlay embodiment discussed (shown in FIG. 1B), additional underlay embodiments disclosed in the following description of specification of the invention and other variants that may fall within the scope of this disclosure. The mounting of heater pixel module as per the configuration shown in FIG. 1 provides for direct contact of the inner surface of the heater pixel module 50 with the fluid 58 circulated inside the bag 60. As mentioned earlier, it may be appreciated that those skilled in the art can devise methods to ensure positive contact between the fluid 58 being circulated and the inner surface of the heater 50 by adequate control of the fluid flow (for example, by a flow restraining valve at the outlet from the bag). The cable routing scheme in this option of the embodiment shown in FIG. 1 is that the wall of the bag on which the heater is being fixed is a double layered wall and the cables are routed from the space 70 between the layers 66 and 68. In this cable routing scheme, the cables are connected to the heater at approximately zero degrees to the inner or outer surfaces of the heater (instead of at approximately 90 degrees in additional embodiments discussed in the following specification description as shown in the FIGS. 2 and 3). The outer surface of the enclosure wall 52 may be affixed to the outer layer 66 of the bag wall where as edges of the inner surface of the heater 50 may be affixed to the inner layer 68 of the bag wall. Therefore, outer layer 66 of the bag wall has an opening engaged with the enclosure wall 52, and inside this enclosure wall the outer surface of the middle of the heater is exposed for contact with fluid 56. The inner layer 68 of the bag wall has an opening at the middle of the heater to expose the inner surface of the heater for contact with cooling fluid 58. The cables can therefore be advantageously routed sandwiched between the inner layer 68 and outer layer 66 of the bag wall.

FIG. 1B illustrates one embodiment of underlay of the invention having elongated heat sink strips 100 connected with each other by flexible and optionally stretchable material 115, and heater pixel modules 125 mounted on the strips such that they can be optionally slided and clamped maintaining desired distance between the heaters using retaining members 130. To assist in maintaining desired distance between the heaters, graduation marks like a scale may be engraved either on the heat sink strips 100 or on the retaining members 130. Laser marking or other engraving means may be employed to mark the graduations. The heaters 125 shown in a view from the front of the heaters (FIG. 1C) may be Peltier heaters (as an example, Part No. 102-1666-ND, Digi-Key Corp, Thief River Falls, Minn., USA) or conventional heaters such as Ceramic heaters (as an example Watlow Ultramic 600 with integrated K-type Thermocouple, Watlow, St. Louis, Mo., USA), Polyimide or Rubber heaters (as an example, rectangular shaped Minco Model No. 5565, circular shaped Minco Model No. 5186 or 5537; Minco, Minneapolis, Minn., USA) attached with one or more temperature sensors (as an example, thermocouples Omega Model Series 5TC, with calibration options J, K, T, or E; Omega Canada, Laval, Quebec). The heater is fixed on the Aluminum or other suitable material heat sink 100 through which cooling medium such as cool or chilled water, or refrigerant liquid or other cooling medium is circulated by input of the medium from a hose connection 150 and output of the medium through a hose connection 155 (FIG. 1D). These connections enable circulation of the cooling medium from a cooler, chiller or refrigeration unit 160 using a pump 165. The heat sinks are connected to each other by flexible hoses or independent sets of input and output hose connections are used depending on the need for cooling efficiency and speed, in different variants of the embodiment and the water circulation path is configured appropriately as can be appreciated by anyone skilled in the art. The heat sink is continuously kept cold and only the heater is controlled On or Off with required frequency using the feedback from the temperature sensor to maintain the set temperature. The outer heat sink strips are attached to flexible strap or belt members 110 and 120 on the two sides. These belt members have means at the loose open ends to attach to each other as a joint 112. The joint is shown as a Velcro™ in the FIG. but can be any other means of joining such as a buckle, hook, or clamp. The lengths of flexible members 110 and 120 are provided suitable to the body part where the TPAD is to be attached. As a standard, the lengths are suitable for attaching the TPAD around a human arm or leg. Optionally, there is provision to extend the length of the members 110 and 120 by fixing extension straps to enable the TPAD to be attached around other body parts such as hips, abdomen, waist, chest, back, neck, and forehead. The pixels may also optionally be distributed into different groups of subassemblies with independent attachment means to enable application to different body parts simultaneously.

The coolant input and output hoses, power and sensor cables are bunched together (not shown in the FIG.) and taken away from the TPAD unit preferably at a direction perpendicular to the contact surface between the TPAD and the human body part (but it can be any angle between 0 degrees to 90 degrees) as it is found to be most suitable to conveniently attach the TPAD with the human body part in many instances. The cables and hoses are clamped by suitable means to avoid stress at their joints with the heaters and heat sinks enabling increased durability.

Figure 2:
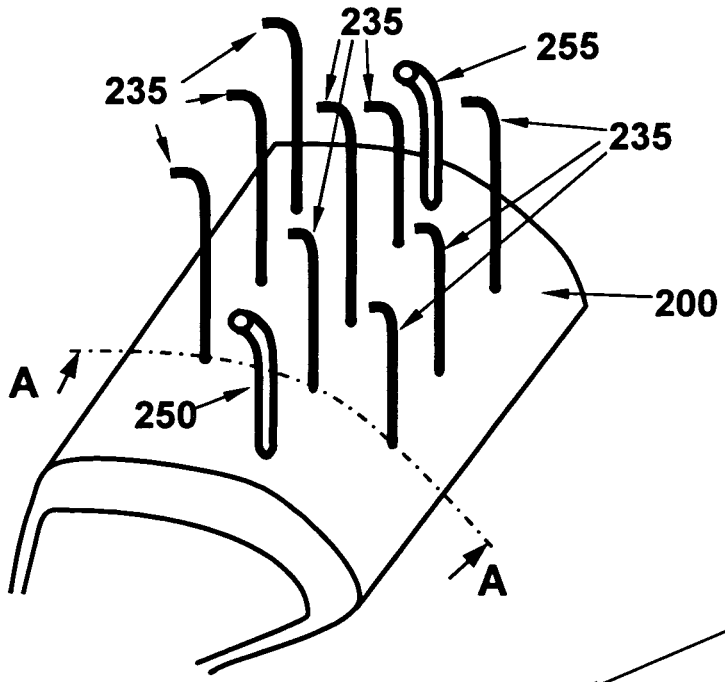
FIG. 2 is a second embodiment of the invention wherein the pixel modules are embedded into a flexible hollow bag in which the cooling medium is circulated.
Figure 2A:
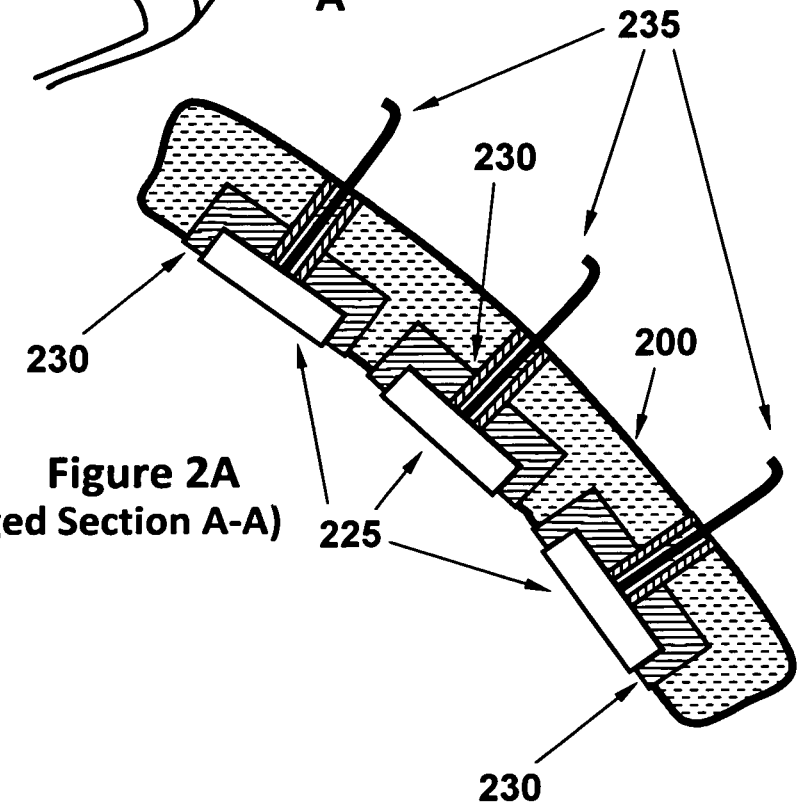
FIG. 2A shows sectional view.

FIG. 2 is a second embodiment of the invention wherein the heater pixel modules are embedded into a flexible hollow bag 200 in which the cooling medium is circulated via input hose connection 250 and output hose connection 255. FIG. 2A (Section A) depicts a cross sectional view of the embodiment. The heaters and temperature sensor integrated units 225 are held by Aluminum or other suitable material heat sinks 230 having integral or connected hollow projections perpendicular to the opposite side of the heat sinks The power cables of heaters and signal cables of the temperature sensors (235) come out from these hollow projections. The flexible hollow bag 200 has a set of concentric openings on the two opposite walls of the bag. Each heat sink and its projected part is sealably connected to the openings of the bag as shown in the cross sectional view. Assembly of an array of heat sink and heater-sensor modules on the corresponding set of openings in the bag configures a flexible TPAD. Belting accessory can be attached to the sides of the bag to enable customized fixing provision suitable for different body parts as described in the earlier embodiment. The design of the embodiment shown in FIG. 2 does not have the provision for adjustment of distance between pixels but is a configuration suitable for convenient donning like a cuff or a glove due to its compact structure.

Figure 3:
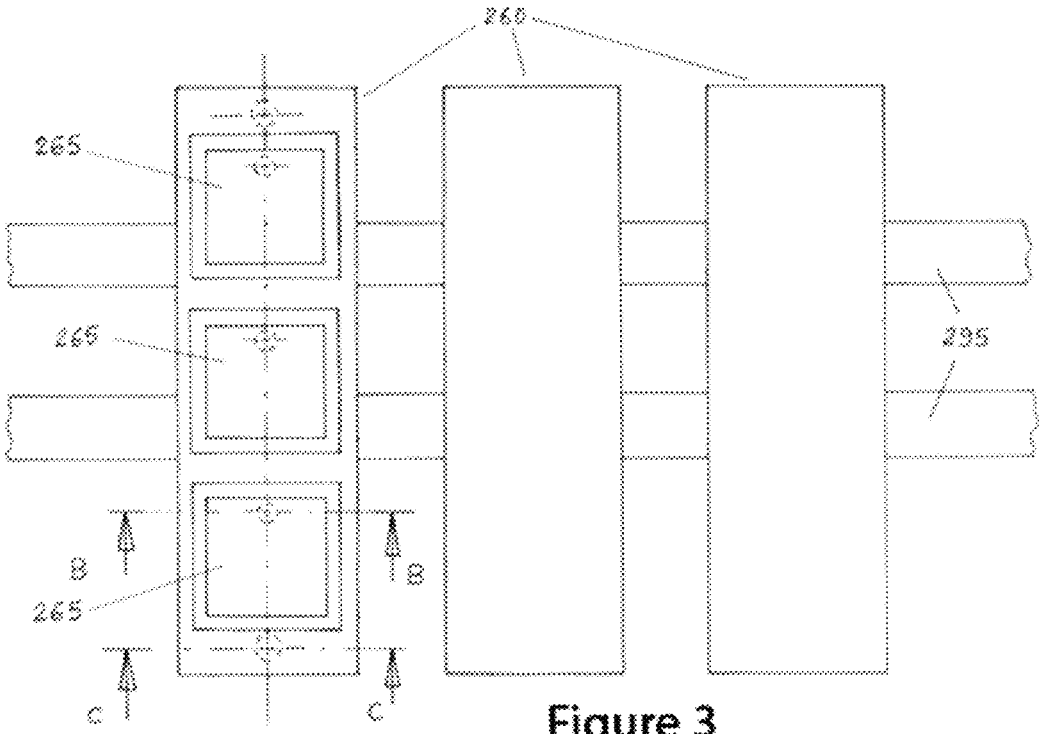
FIG. 3 shows a variant of this embodiment wherein modules of smaller bag are connected on a set of straps enabling adjustment of distance between the pixels in one direction.

FIG. 3 shows a variant of this embodiment wherein modules of smaller bag 260 are connected on a set of straps 295 enabling adjustment of distance between the pixels in one direction. This adjustment is possible by different variables of the strap configuration. In one variable, the strap is stretchable elastic providing means to increase the distance between the modules 260. In another variable, the length of strap between adjacent modules 260 can be varied using a standard strap slide adjuster. In yet another variable, the link in the modules 260 may have a ratchet that may allow relative motion between the module and the strap by application of certain sliding force, and then the module may be retained in the position to which it is left after the sliding.

Figure 3A:
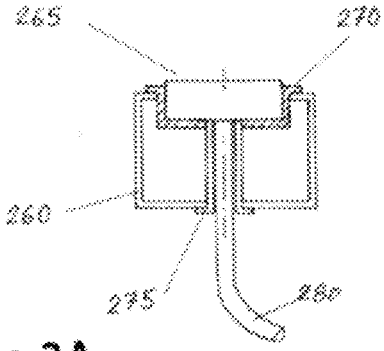
FIG. 3A and FIG. 3B are sectional views.
Figure 3B:
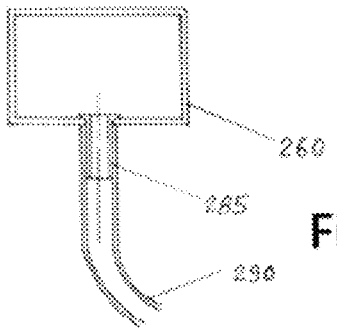

Embodiment of FIG. 3 has a heater 265 fixed on an Aluminum or other material heat sink 270 having a hollow projected part 275 through which a set of power and sensor cables are taken out from a pixel as illustrated in FIG. 3A. Hose connection for input and output of cooling medium to the module 260 is as shown in FIG. 3B. A hose 290 is connected to the module 260 using a nipple 285 attached sealably to the opening in the bag module 260.

The disposition of mounting of heaters and the routing of power and signal cables shown in embodiments of FIGS. 2 and 3 are only examples of several possibilities that may be readily conceived by those skilled in the art by developing equivalents, variants, and alterations that fall within the scope and spirit of the present disclosure. For example, Peltier, Ceramic, Polyimide, Kapton™ or Rubber heaters may be directly affixed on a wall of flexible hollow bag 200 or bag 260 without using an Aluminum or other material heat sink 230 or 270 respectively. In such a variant, there can be an opening in the bag wall at the middle portion of the heater while the edges of the heater are sealably affixed to the bag wall. This will provide for direct contact of the inner surface of the heater with the fluid circulated inside the bag. It can be appreciated that those skilled in the art can devise methods to ensure positive contact between the fluid being circulated and the inner surface of the heater by adequate control of the fluid flow (for example, by a flow restraining valve at the outlet from the bag). An example of an alternate cable routing scheme may be that the wall of the bag on which the heater is being fixed can be a double layered wall and the cables are routed from between the layers. In such a cable routing scheme, the cables are connected to the heater at approximately zero degrees to the inner or outer surfaces of the heater (instead of at approximately 90 degrees as shown in the Figs.). The edges of the outer surface of the heater may be affixed to the outer layer of the bag wall where as edges of the inner surface of the heater may be affixed to the inner layer of the bag wall. The outer layer of the bag wall has an opening at the middle of the heater to expose the outer surface of the heater for contact with a human body part. The inner layer of the bag wall has an opening at the middle of the heater to expose the inner surface of the heater for contact with cooling fluid. The cables can therefore be advantageously routed sandwiched between the inner and outer layers of the bag wall.

Figure 4:
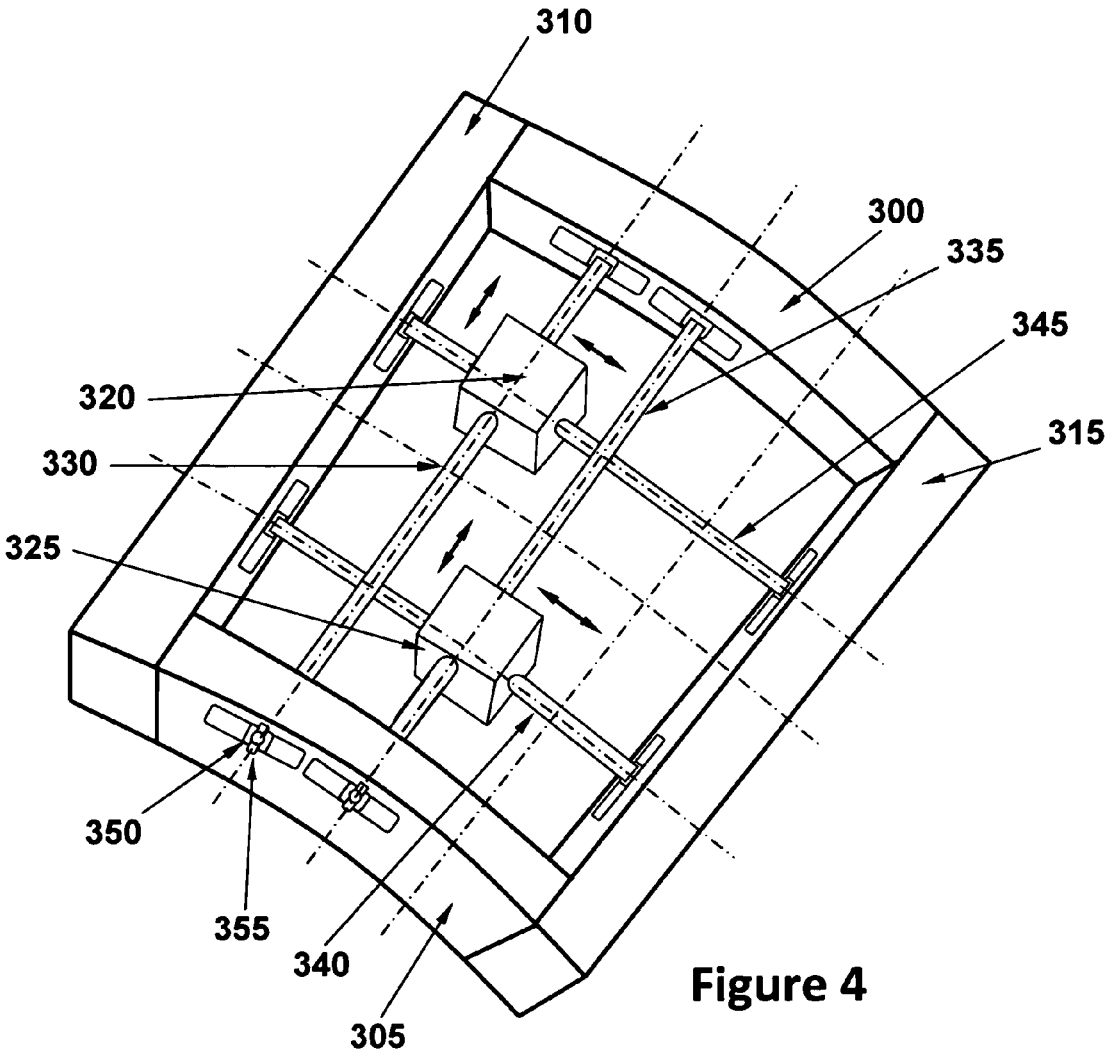
FIG. 4 is a third embodiment of the invention wherein the pixel modules are held by a set of cables perpendicular to each other.

FIG. 4 is a third embodiment of the invention wherein the heater pixel modules (only 2 of the modules 320 and 325 shown in the FIG. to improve clarity reducing clutter) are held by a set of flexible cables 330, 335 and 340, 345 perpendicular to each other. The blocks 350 holding the ends of cables can be slided in the guideway slots of the outer frame constructed of members 300, 305, 310 and 315; and clamped (using a clamping member 355, such as a wing nut) maintaining desired distance between pixels. The frame is semi-flexible providing means to slide the blocks and clamp them and at the same time to conform to a curved surface.

FIG. 5 illustrates one configuration of the detailed structure of a pixel module of FIG. 4. The cross sectional views are shown in FIGS. 5A, 5B, 5C, and 5D. The pixel module is held on flexible cables 330 and 345 perpendicular to each other as shown. The locations of bores for the guiding cables are such that a chamber 321 for circulation of cooling medium is provided in the module without interference with the path of the guiding cables (FIGS. 5A and 5C). Chamber 321 is connected to coolant input and output hoses 360 and 361 by bores as shown (FIG. 5B). Further, chamber 321 is also separated from the route of the power and sensor cables 317 coming out from the integrated heater-sensor unit 316 (FIG. 5D).

Figure 6:
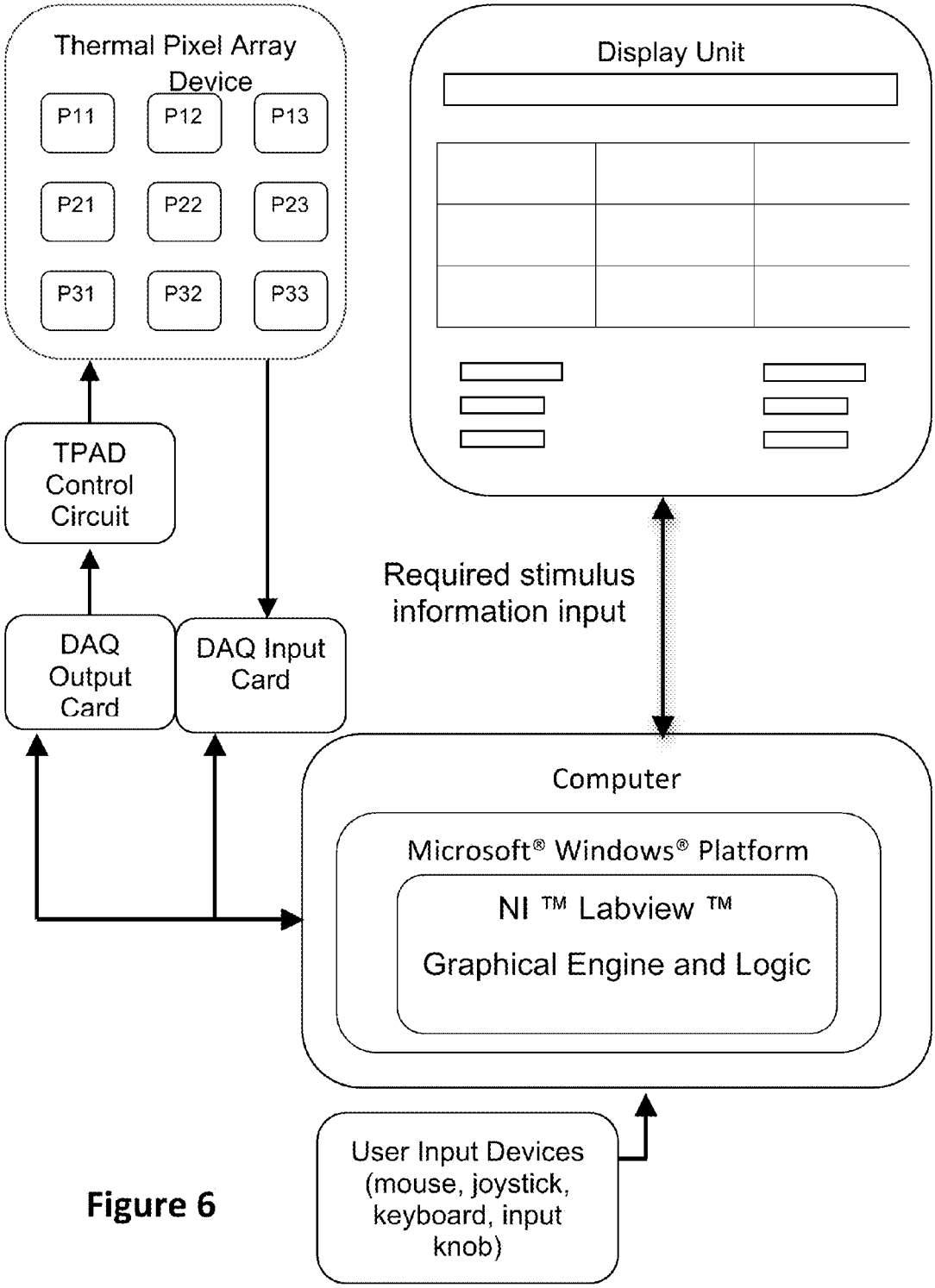
FIG. 6 shows an embodiment of overall system configuration of the invention showing input interface.

An embodiment of overall system configuration depicted in FIG. 6 consists of Thermal Pixel Array Device (TPAD) with an array of pixels configured as per any of the disclosed preferred embodiments illustrated by way of example as a 3×3 matrix of 9 pixels: P11, P12, P13 in a first row; P21, P22, P23 in a second row; and P31, P32, P33 in a third row. There can be any combinations of the number of rows and columns and thus the number of pixels in each row and column.

The TPAD unit is connected to a TPAD control circuit, Data Acquisition (DAQ) Output and Data Acquisition (DAQ) Input sub-system and engaged in bidirectional communication through signal and power transmission to enable generation of a pattern of different temperature of pixels on the TPAD in a programmable and controllable manner. This controller sub-system is interfaced with a computer having Microsoft Microsoft® Windows® Platform and NI™ Labview™ Graphical Engine and Logic (National Instruments, Austin, Tex., USA) for the Graphical User Interface. A computer is connected with user input devices, namely, a mouse, joystick, keyboard, and an input knob. The computer is also connected with a display unit such as a conventional raster scan monitor or LCD display.

Desired values of temperatures of the pixels can be input using the keyboard and mouse in a simulated graphical representation of the pixels on the display unit in the form of a corresponding table as shown in the display unit of FIG. 6. There are additional fields in the graphical representation that provide input of other useful parameters such as the variables of an experiment, name of subject, etc.

Figure 7:
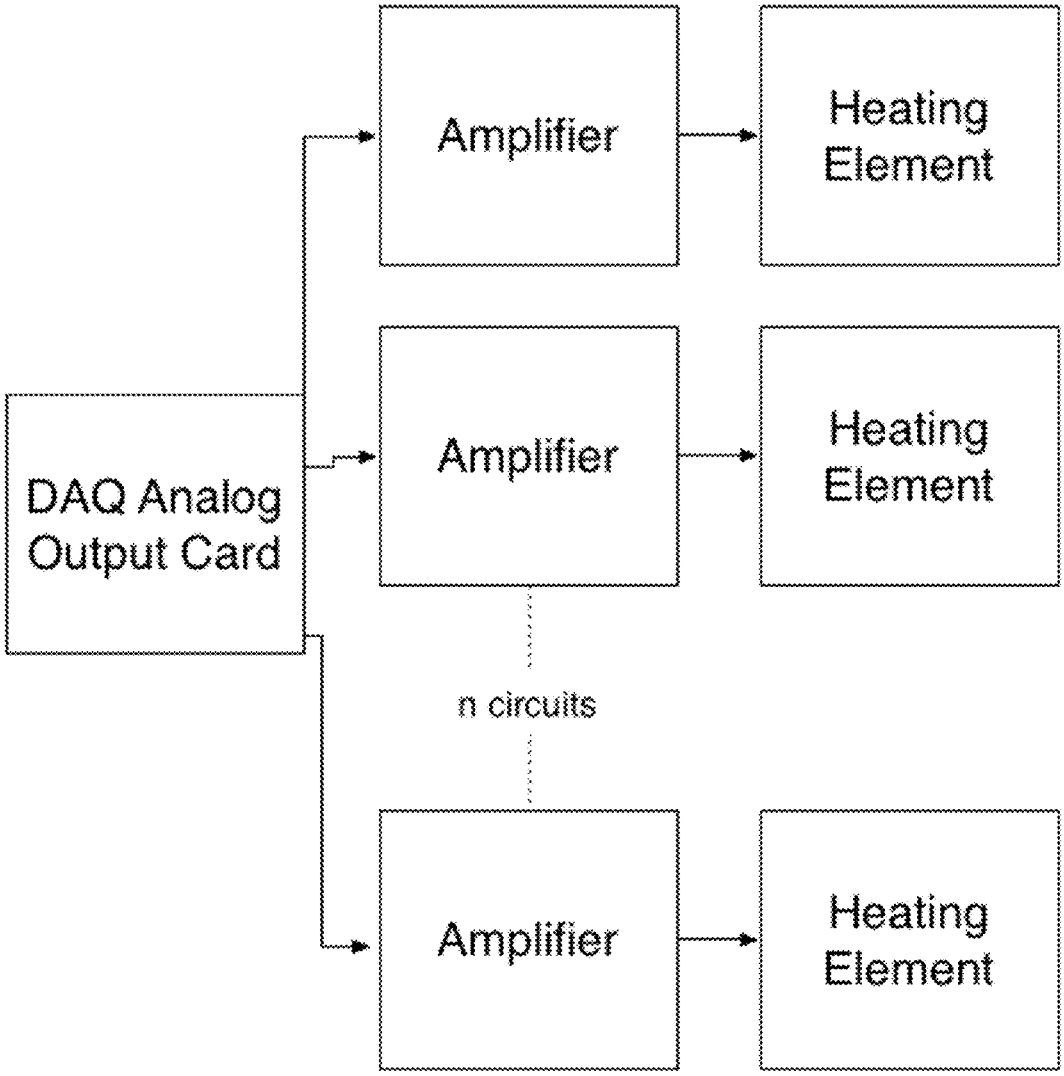
FIG. 7 is an embodiment of schematic of Thermal Pixel Array Device (TPAD) control of FIG. 6.
Figure 8:
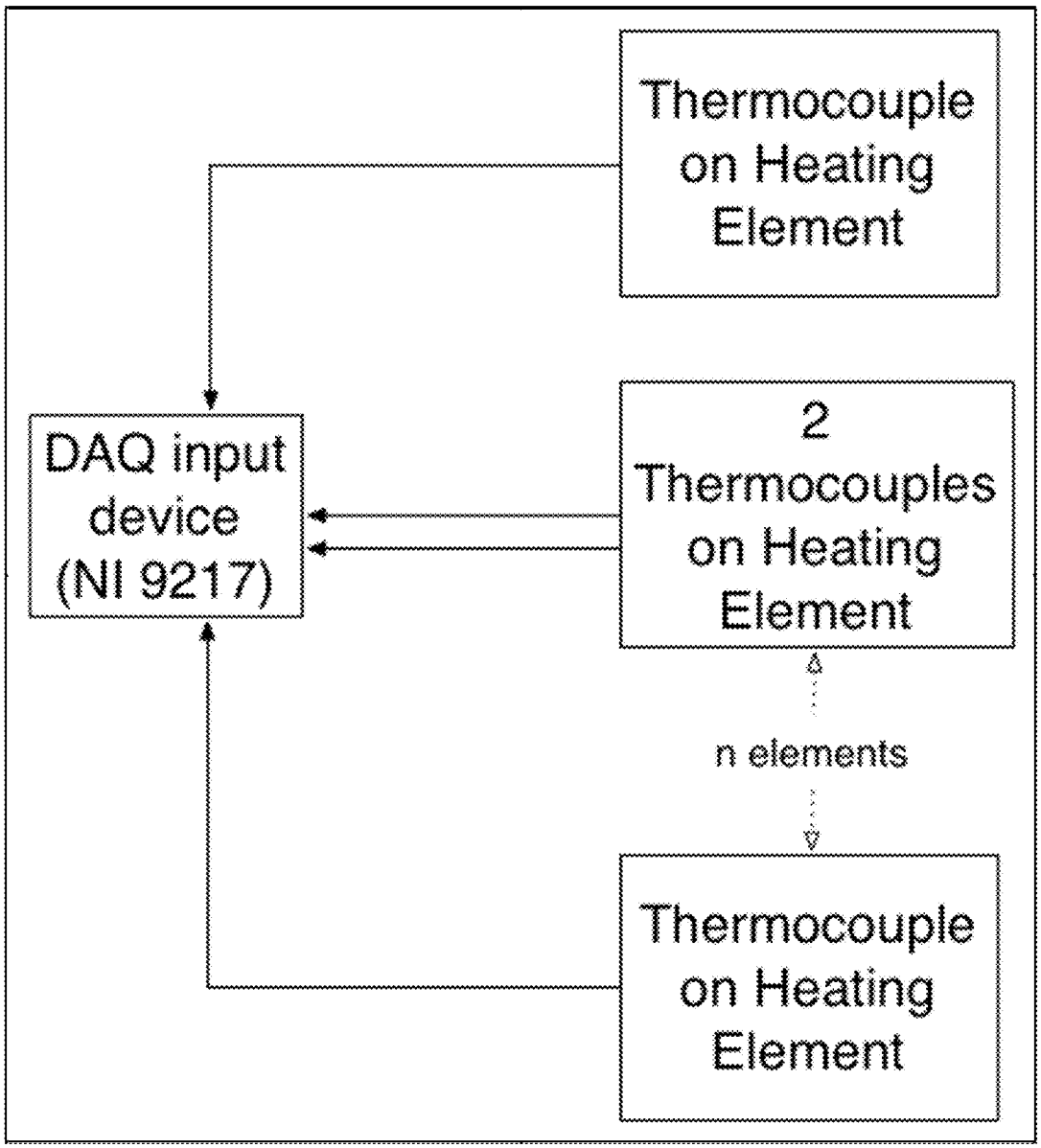
FIG. 8 is an embodiment of schematic of TPAD temperature measurement for display and for feedback control to maintain the set temperature by on-off of the heaters.

An embodiment of schematic of TPAD control is as per FIG. 7 in which the strength and frequency of the input power to the TPAD pixels is controlled by a Data Acquisition (DAQ) output card, amplifier, and a power supply. The control is closed loop and the set constant temperature of a particular pixel is achieved based on measured values of the temperature on pixel obtained by one or more temperature sensors attached or embedded with the pixel. By way of example, a configuration with one such temperature sensor (Thermocouple) using one or two units each heating element (for number of heating elements n) is depicted in FIG. 8. Multiple temperature sensors maybe optionally used to improve the safety and reliability of the system functioning by providing redundancy. Multiple temperature sensors may also be used for obtaining temperature information at different locations of the pixel, such as, at the heater and at the outer surface of the heater module that comes in actual contact with human skin. The measured temperature information is fed to a DAQ Input Card (for example, NI™ model 9217; alternate models that can be used being model cDAQ NI 9263, model 9264, USB compatible model 6210 and any other upgraded models that may be available from time to time) for feedback control to maintain the set temperature by on-off of the heaters by required frequency. DAQ cards built from components or available off the shelf of other makes, models, and sources may also be used.

Figure 7A:
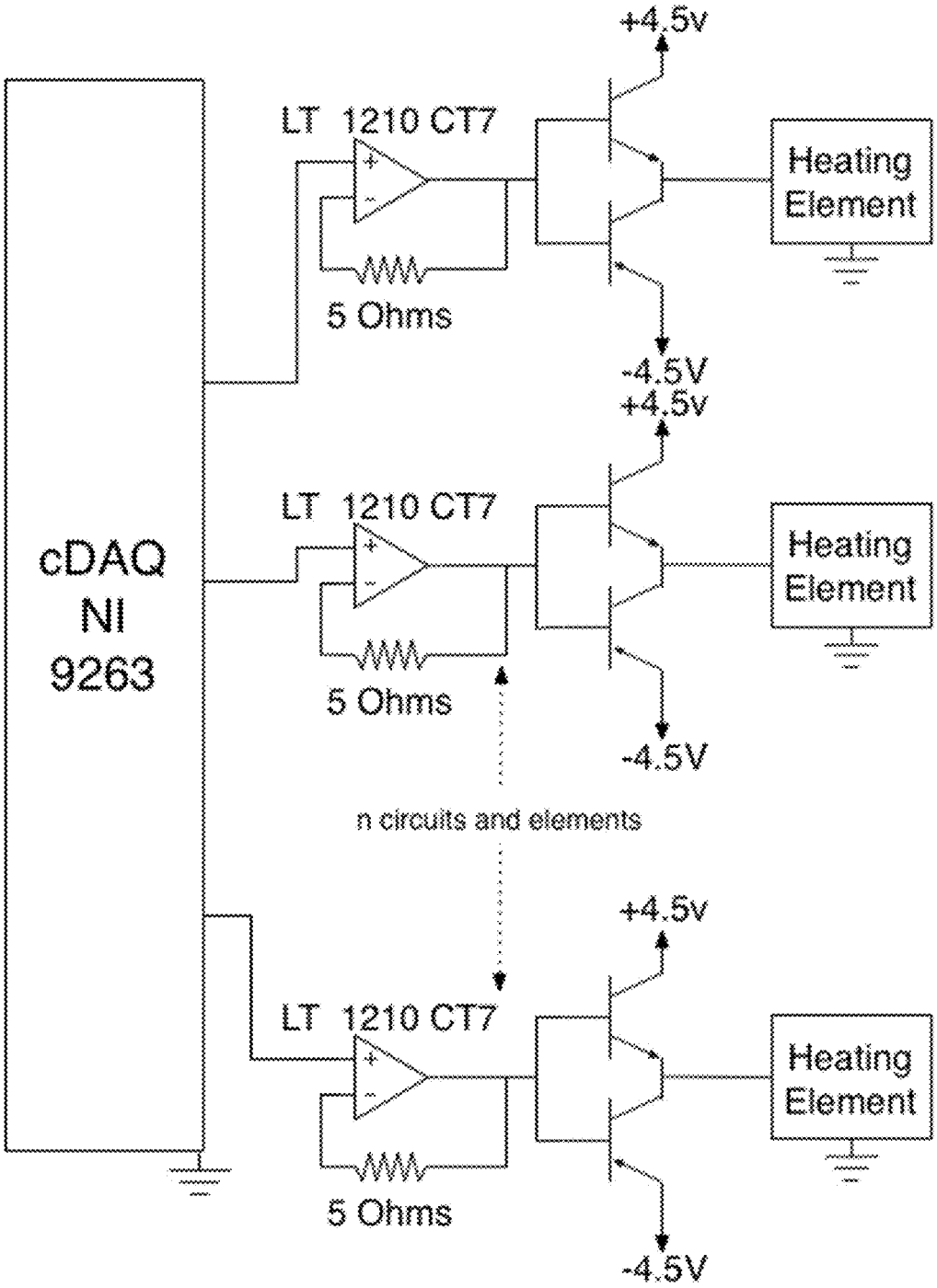

Schematic of TPAD control shown by way of example is only one of several possibilities that may be readily conceived by those skilled in the art by developing equivalents, variants, and alterations that fall within the scope and spirit of the present disclosure. For example, an additional temperature module NI™ 9211 or 9213 (National Instruments, Austin, Tex., USA) may be used for connecting the thermocouples. Further, chassis NI cDAQ-9174 or NI cDAQ-9174 (National Instruments, Austin, Tex., USA) may be used to adopt certain DAQ cards. In addition, accessories such as thermocouple amplifiers and junction compensators (for example, Monolithic Thermocouple Amplifier with Cold Junction Compensation, Model AD594/AD595, Analog Devices Inc, Norwood, Mass., USA) can be used in the circuit for improvements. In case of use of Peltier heater, to reverse heating to cooling in a cyclic manner, a H-bridge may be employed in the circuit (for example, Dual H Bridge Driver Model No. NJM 2670, NJR Corp, San Jose, Calif., USA) or a combination of Darlington transistors (for example, TIP 122 and TIP 127 from Fairchild Semiconductor, Irving, Tex., USA) and additionally but optionally an Operational Amplifier (for example, LT1210 CT7 from Linear Technology, Milpitas, Calif., USA) may be employed in the circuit as shown in FIG. 7A. A number of circuits for controlling a number of elements maybe employed, for example, n circuits maybe required to control n number of heating elements. It may also be appreciated by those skilled in the art that the control circuit can be operated through a microprocessor, a Field Programmable Gate Array (FPGA), or a System on Chip (SOC) such as a PC 104 Controller.

Figure 9:
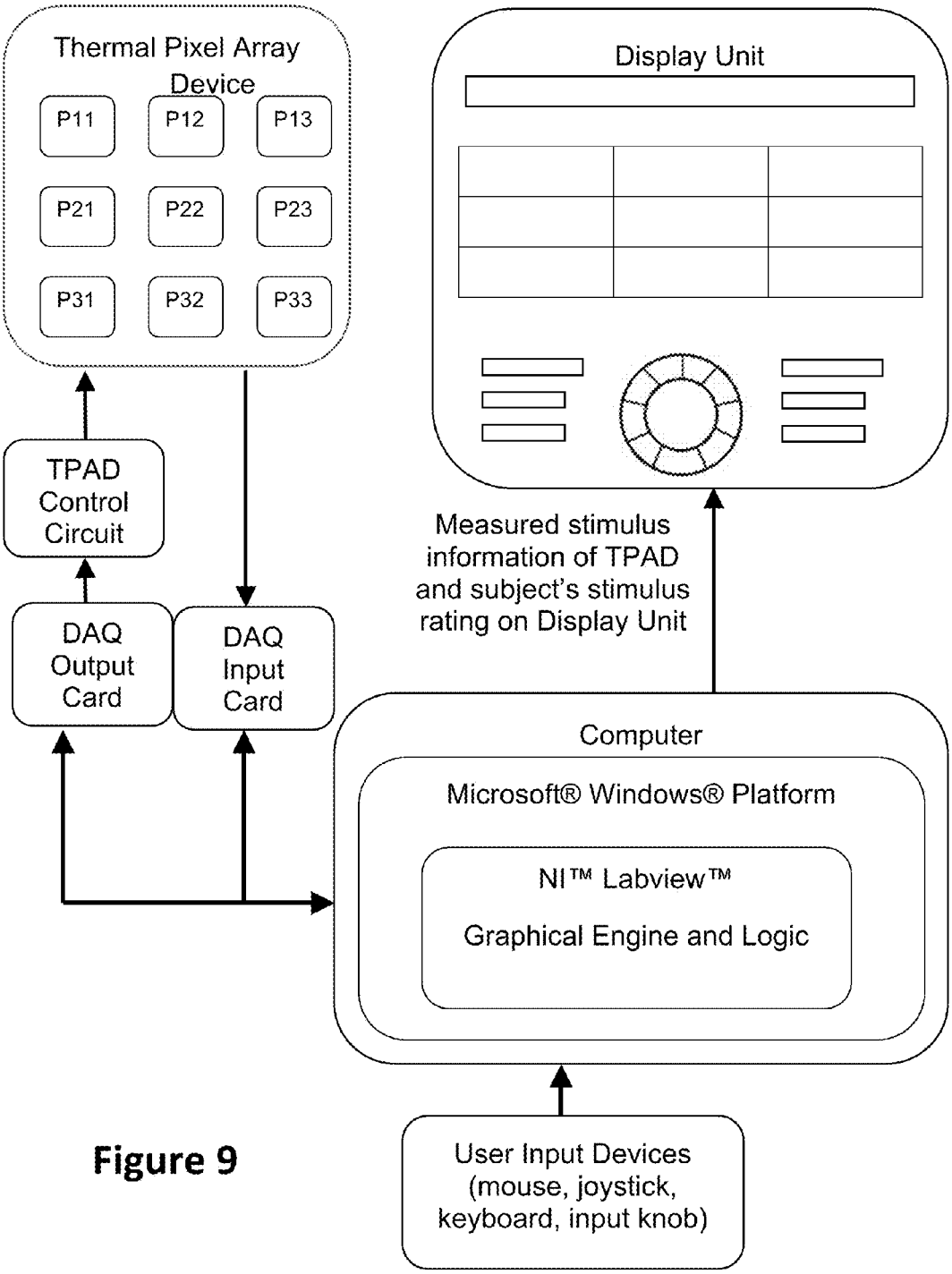
FIG. 9 is an embodiment of overall system configuration showing output display.

In addition, optionally, in the embodiment of the invention applicable for research on perception of stimulation, the measured stimulus values are displayed on a different window of the display unit, an example display being as depicted in FIG. 9. This display window has tables, graphs and fields that illustrate the actual measured values and values or pictorial representations depicting the analysis of data. The display window also shows the feedback of the subject input by the subject using the input knob. By rotating the input knob in a particular direction (clockwise or anti-clockwise), the subject indicates the level of temperature (heat or cold), actuation, or vibration and thus the feeling of stimulus experienced on the subject's body. This is correspondingly indicated graphically by the graduated circular indicator shown on the bottom middle location of the display unit in FIG. 9. Different segments of the indicator may change color or shade to indicate the increasing value of stimulus experienced. Rotation of the input knob in opposite direction results in corresponding retraction of the color or shade of the graduations on the display unit. The graduations are typically marked from 1 to 10 to indicate the value of experienced stimulus on a scale of minimum (1) to maximum (10). The input knob may be a hardware knob or a virtual knob operated by movement of a computer mouse. In case of a virtual knob, the clicking of the mouse by the subject captures the maximum level of stimulus experienced by the subject corresponding to the graphical indication on the graduated circular indicator. A table indicating the values of temperatures at different instances of time may be formulated and a file containing the table saved in the computer at a designated location automatically when the mouse button is clicked.

We claim:

1. A thermal pixel array device for pain research, communication, education or enhanced perception in gaming applications comprising:

an array of heaters having at least three heaters serving as a pixel array for providing a stimulus for stimulating a human subject;

a means to hold the heaters such that one side of the heaters can position substantially conforming to shape of a curved surface and at the same time providing for changing the distance between a pair of heaters independent from the distance between another pair of heaters by sliding and clamping means in one direction and in addition optionally providing for change in distances between heaters at a direction 90 degrees with respect to the first direction by means of stretching or sliding and clamping;

a means to cool the heaters;

a means for programmable control of temperatures of individual heaters in the array independent from each other.

2. A thermal pixel array device of claim 1 wherein the heater is a ceramic heater, a polyimide heater, Kapton™ heater or a rubber heater.

3. A thermal pixel array device of claim 1 wherein the heater is a Peltier heater.

4. A thermal pixel array device of claim 1 wherein the heaters are held by flexible material providing compliance for contact with curved surface.

5. A thermal pixel array device of claim 1 wherein the heaters are mounted on rigid members having means to individually slide and clamp the heaters, the said rigid members connected by flexible material providing compliance for contact with curved surface.

6. A thermal pixel array device of claim 1 wherein the cooling is by circulation of a fluid or gas medium circulated through a flexible enclosure.

7. A thermal pixel array device of claim 6 wherein the heater directly comes in contact with the cooling medium.

8. A thermal pixel array device of claim 1 wherein the means of programmable control of temperatures of individual heaters causing stimulus on a human body part comprises at least one temperature sensor, and at least one data acquisition card.

9. A thermal pixel array device of claim 1 wherein the means of programmable control of temperatures of individual heaters causing stimulus on a human body part comprises at least one temperature sensor, and at least one of a microprocessor, a Field Programmable Gate Array (FPGA), and a System on Chip (SOC) such as a PC 104 Controller.

10. A thermal pixel array device of claim 1 wherein controller provides a closed loop programmable pattern of different temperatures of pixels.

11. A thermal pixel array device of claim 1 wherein a graphical display is provided to view the programmable control parameters of temperatures in at least one of graph and tabular formats.

12. A method of use of the thermal pixel array device of claim 1 wherein a human subject provides feedback on the degree of stimulus felt by sensation of the pixels on said human subject, by the human subject effecting:

(a) rotation of a knob or (b) moving of a cursor on a graphical display screen by corresponding movement of a computer mouse while the level of stimulus felt is being displayed on a graphical display screen as a graph bar, and recorded in a computer in a soft form as one or more files comprising graphs or tables.

13. A thermal pixel array device of claim 1 wherein the means for programmable control of temperatures of individual heaters in the array can change the temperature at rates falling anywhere within a range between 0.1 degrees C/sec and 20 degrees C/sec.

14. A thermal pixel array device of claim 1 wherein the device is portable and thus attachable to a human body part including parts that have a curved surface.

15. A thermal pixel array device of claim 1 wherein an overlay of fluid chamber over at least one heater pixel further provides stimulation in the form of any one of thermal stimulation, actuation stimulation, vibration stimulation, or a combination of two or more of them by using the thermal energy; the overlay comprising:

an enclosure wall with one edge attached to the heater pixel;

at least one of a flexible film sealably engaged with the other edge of the enclosure wall, or a piston pin sealably and slidably engaged with inner surface of the enclosure wall;

fluid enclosed within the sealed chamber formed between the heater pixel, enclosure wall and flexible film;

means to cool the fluid.

16. A thermal pixel array device of claim 1 wherein an overlay of fluid chamber over at least one heater pixel further provides stimulation in the form of any one of thermal stimulation, actuation stimulation, vibration stimulation, or a combination of two or more of them by using the thermal energy; the overlay comprising:

an enclosure wall with one edge attached to the heater pixel, the wall comprising embedded heater coil;

at least one of a flexible film sealably engaged with the other edge of the enclosure wall, or a piston pin sealably and slidably engaged with inner surface of the enclosure wall;

fluid enclosed within the sealed chamber formed between the heater pixel, enclosure wall and flexible film;

means to cool the fluid.

17. An actuator comprising a thermal pixel and overlay of claim 15.

18. An actuator comprising a thermal pixel and overlay of claim 16.

* * * * *